US010651552B2

(12) United States Patent
Lin et al.

(10) Patent No.: US 10,651,552 B2
(45) Date of Patent: May 12, 2020

(54) ENABLE A RADIATING ELEMENT BASED ON AN ORIENTATION SIGNAL

(71) Applicant: HEWLETT-PACKARD DEVELOPMENT COMPANY, L.P., Houston, TX (US)

(72) Inventors: Cheng-Fang Lin, Taipei (TW); Huai-Yung Yen, Taipei (TW); Wan Lin Su, Taipei (TW)

(73) Assignee: Hewlett-Packard Development Company, L.P., Spring, TX (US)

( * ) Notice: Subject to any disclaimer, the term of this patent is extended or adjusted under 35 U.S.C. 154(b) by 458 days.

(21) Appl. No.: 15/105,142

(22) PCT Filed: Jan. 3, 2014

(86) PCT No.: PCT/US2014/010136
§ 371 (c)(1),
(2) Date: Jun. 16, 2016

(87) PCT Pub. No.: WO2015/102636
PCT Pub. Date: Jul. 9, 2015

(65) Prior Publication Data

US 2016/0322701 A1 Nov. 3, 2016

(51) Int. Cl.
*H01Q 1/52* (2006.01)
*H01Q 1/24* (2006.01)
*H01Q 3/24* (2006.01)

(52) U.S. Cl.
CPC ..... *H01Q 1/52* (2013.01); *H01Q 1/242* (2013.01); *H01Q 1/243* (2013.01); *H01Q 1/245* (2013.01); *H01Q 3/24* (2013.01)

(58) Field of Classification Search
CPC ..... H01Q 1/52; H01Q 3/24; H01Q 1/245; H01Q 1/242; H01Q 1/243
See application file for complete search history.

(56) References Cited

U.S. PATENT DOCUMENTS

2009/0160784 A1 6/2009 Ishida
2009/0284438 A1* 11/2009 Matsunaga ..... H01Q 1/2291 343/876
2012/0052820 A1 3/2012 Lin et al.
2012/0276861 A1 11/2012 Isobe et al.
2014/0002305 A1 1/2014 Hsu et al.

FOREIGN PATENT DOCUMENTS

JP 2013247503 12/2013
WO WO-2013101106 7/2013

* cited by examiner

*Primary Examiner* — Graham P Smith
*Assistant Examiner* — Jae K Kim
(74) *Attorney, Agent, or Firm* — HP Inc. Patent Department

(57) ABSTRACT

Example implementations relate to enabling a radiating element based on an orientation signal. For example, a method may include receiving at a controller of a computing device an orientation signal from an orientation sensor. The orientation signal corresponds to a first orientation of an antenna element of the computing device. The method may also include enabling via the controller a first radiating element of the antenna element based on the orientation signal. The method may further include disabling via the controller a second radiating element of the antenna element based on the orientation signal.

15 Claims, 7 Drawing Sheets

ENABLE A RADIATING ELEMENT BASED ON AN ORIENTATION SIGNAL

BACKGROUND

The effect of radiation from a computing device, such a smartphone, on human health is the subject of recent interest and study. Radiation is measured by a specific absorption rate (SAR). SAR is the rate at which energy is absorbed by a human body when the human body is exposed to radio frequency (RF) electromagnetic field.

BRIEF DESCRIPTION OF THE DRAWINGS

Some examples of the present application are described with respect to the following figures.

DETAILED DESCRIPTION

Figure 1A:
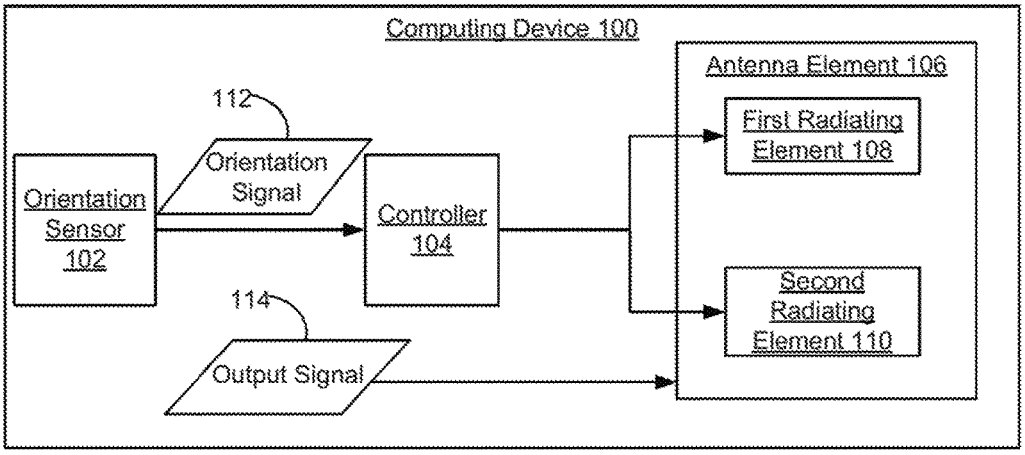
FIG. 1A is a block diagram of art example computing device for enabling a radiating element based on an orientation signal.

As described above, radiation is measured by a specific absorption rate (SAR). SAR of a computing device, such as a mobile phone, a smartphone, a laptop computer, or a tablet computing device, is subject to regulation by government agencies. For example, in United States, the Federal Communications Commission (FCC) has set a SAR limit of 1.6 watts per kilogram (W/kg) averaged over a volume of 1 gram of human tissue. However, the SAR limit may be subject to change. The current product design trend of a computing device focuses on making the computing device thinner. However, as a computing device is getting thinner, available space on the computing device to implement an antenna element that is compliant with a SAR, such as the SAR limit set by the FCC, is decreasing. Thus, design complexity of the antenna element is increased.

Examples described herein address the above challenges by providing a computing device that selectively enables a radiating element based on an orientation signal. For example, a computing device, such as a tablet computing device, may include an antenna element. The antenna element may include a first radiating element and a second radiating element. The first radiating element may have a first power output that is compliant with SAR when the antenna element is in a first orientation. The second radiating element may have a second power output that exceeds the SAR when the antenna element is in the first orientation. Based on an orientation signal indicating that the antenna element is in the first orientation, the computing device may enable the first radiating element and disable the second radiating element via a switching element. Thus, the use of an attenuator to reduce a power output of a radiating element may be avoided. In this manner, examples described herein may reduce a design complexity of implementing an antenna element that is compliant with a SAR on a computing device.

In one example, a computing device includes an orientation sensor, an antenna element, and a controller. The antenna element includes a first radiating element and a second radiating element. The controller to enable a first radiating element of an antenna element to transmit an output signal based on an orientation signal received from the orientation sensor. The controller further to disable a second radiating element of the antenna element based on the orientation signal. The orientation signal corresponds to a first orientation of the antenna element. The first radiating element has a first power output that is compliant with a specific absorption rate (SAR) when the antenna element is in the first orientation. The second radiating element has a second power output that exceeds the SAR when the antenna element is in the first orientation.

In another example, a method includes receiving, at a controller of a computing device, an orientation signal from an orientation sensor. The orientation signal corresponds to a first orientation of an antenna element of the computing device that is in closer physical proximity to a user than a second orientation of the antenna element. The method also includes enabling, via the controller, a first radiating element of the antenna element based on the orientation signal. The method further includes disabling, via the controller, a second radiating element of the antenna element based on the orientation signal. The first radiating element has a first power output that is different than a second power output of the second radiating element.

In another example, a computer-readable storage medium comprising instructions when executed cause a controller of a computing device to receive an orientation signal from an orientation sensor. The orientation signal corresponds to a first orientation of an antenna element that is in closer physical proximity to a user than a second orientation of the antenna element. The instructions when executed also cause the controller to enable a first radiating element of the antenna element based on the orientation signal. The first radiating element has a first power output that is compliant with a specific absorption rate (SAR) when the antenna element is in the first orientation. The instructions when executed further cause the controller to disable a second radiating element of the antenna element based on the orientation signal. The second radiating element has a second power output that exceeds the SAR when the antenna element is in the first orientation.

Referring now to the figures, FIG. 1A is a block diagram of an example computing device 100 for enabling a radiating element based on an orientation signal 112. Computing device 100 may be, for example, a laptop computer, a desktop computer, an all-in-one system, a tablet computing device, a mobile phone, an electronic book reader, or any other electronic device suitable for transmitting a signal wirelessly. Computing device 100 may include an orientation sensor 102, a controller 104, and an antenna element 106.

Orientation sensor 102 may be a device that detects an orientation of antenna element 106. For example, orientation sensor 102 may include a gravity sensor, an accelerometer, a single axis gyroscope, or any combination thereof. Antenna element 106 may include a first radiating element 108 and a second radiating element 110. In some examples, antenna element 106 may be fixedly located in computing device 100. Antenna element 106 may be a device that transmits a signal using radio waves. Radiating elements 108 and 110 may be devices that convert electric power into radio waves. As an example, first radiating element 108 may be a first patch antenna that has a first antenna trace. Second radiating element 110 may be a second patch antenna that has a second antenna trace. The first antenna trace may have a different length than the second antenna trace. In some examples, the first antenna trace may have a greater length than the second antenna trace.

First radiating element 108 may have a first power output that is compliant with a SAR when antenna element 106 is in the first orientation. For example, the SAR may be a SAR limit set by the FCC. Second radiating element 110 may have a second power output that exceeds the SAR when antenna element 106 is in the first orientation. The second power output may be compliant with the SAR when antenna element 106 is in an orientation other than the first orientation. The second power output may be higher than the first power output.

Controller 104 may be a device to selectively enable and/or disable one of first radiating element 108 and second radiating element 110. For example, controller 104 may be a processor, a semiconductor-based microprocessor, an integrated circuit (IC), or any other device suitable for selectively enabling and/or disabling first radiating element 108 and/or second radiating element 110.

During operation, orientation sensor 102 may detect an orientation of antenna element 106. As used herein, an orientation of antenna element 106 may be a position of antenna element 106 relative to a user of computing device 100. An orientation of antenna element 106 may include a landscape-primary orientation, a landscape-secondary orientation, a portrait-primary orientation, and a portrait-secondary orientation. Example orientations of antenna element 106 are described in more detail with reference to FIGS. 1B and 1C. Orientation sensor 102 may generate an orientation signal 112 that corresponds to the orientation of antenna element 106. Controller 104 may receive orientation signal 112 from orientation sensor 102. Orientation signal 112 may be any signal that can be used to represent an orientation of a device. For example, orientation signal 112 may be a digital signal, an analog signal, or an electrical signal. Based on the orientation signal 112, controller 104 may determine that antenna element 106 may be in closer physical proximity to a potential use of computing device 100 than other orientations of antenna element 106. For example, controller 104 may use a look-up table to make the determination.

Controller 104 may enable and/or disable one of first radiating element 108 and second radiating element 110 based on orientation signal 112. For example, when controller 104 determines that orientation signal 112 corresponds to a first orientation of antenna element 106, controller 104 may enable first radiating element 108 and disable second radiating element 110. Thus, an output signal 114 may be transmitted via first radiating element 108.

As another example, when controller 104 determines that orientation signal 112 or another orientation signal that corresponds to another orientation that is different from the first orientation, controller 104 may disable first radiating element 108 and enable second radiating element 110. Thus, output signal 114 may be transmitted via second radiating element 110. Controller 104 may use a look-up table to determine what orientation signal 112 corresponds to.

As used herein, "enable" may mean making a radiating element available for signal transmission. For example, controller 104 may enable first radiating element 108 by coupling a signal trace (not shown in FIG. 1A) used to route an output signal 114 for transmission to first radiating element 108 via a switching element. The switching element may include a transistor, a diode, any circuits or devices to selectively couple a radiating element to a signal trace. As used herein, "disable" may mean making a radiating element unavailable for signal transmission. For example, controller 104 may disable second radiating element 110 by decoupling the signal trace from second radiating element 110 via the switching element.

Accordingly, when computing device 100 is in the first orientation, output signal 114 may be transmitted via first radiating element 108 so that the SAR is satisfied. When computing device 100 is in another orientation other than the first orientation, output signal 114 may be transmitted via second radiating element 110 the SAR is satisfied while obtaining a better signal transmission performance as compared to transmitting output signal via first radiating element 108.

Thus, by selectively enabling and/or disabling one of first radiating element 108 and second radiating element 110 via controller 104, controller 104 may enable computing device 100 to be compliant with the SAR regardless of an orientation of antenna element 106. Further, by using a switching element to selectively enable and/or disable one of first radiating element 108 and second radiating element 110, the use of an attenuator to reduce power output of a radiating element may be avoided. Thus, space needed to implement antenna element 106 may be reduced.

Figure 1B:
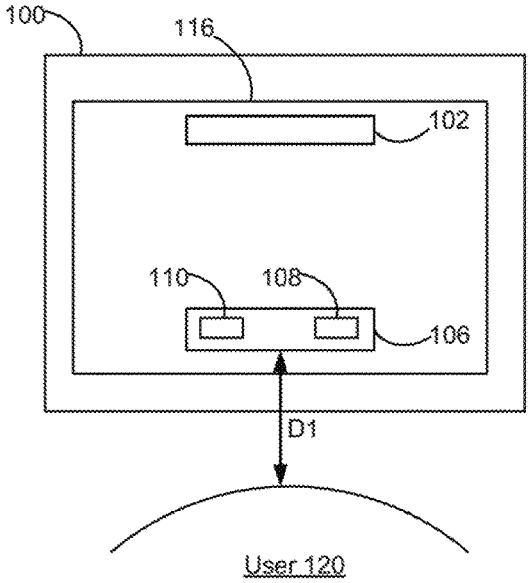
FIG. 1 is a block diagram of an example orientation of an antenna element of FIG. 1A in which a first radiating element is enabled and a second radiating element is disabled based on a first orientation signal.
FIG. 1C is a block diagram of an example orientation of the antenna element of FIG. 1A in which the second radiating element is enabled and the first radiating element of FIG. 1B is disabled based on a second orientation signal.

FIG. 1B is a block diagram of an example orientation of antenna element 106 in which first radiating element 108 is enabled and second radiating element 110 is disabled based on an orientation signal. As illustrated in FIG. 1B, antenna element 106 may be in the landscape-primary orientation. Orientation sensor 102 and antenna element 106 may be located in a display panel 116 of computing device 100. Orientation sensor 102 may generate a first orientation signal, such as orientation signal 112 of FIG. 1A. Controller 104 may enable first radiating element 108 and disable second radiating element 110 based on the first orientation signal.

When computing device 100 is in the landscape-primary orientation, antenna element 106 may be a distance D1 away from a user 120. Distance D1 may correspond to a shortest distance from antenna element 106 to user 120 as compared to a distance from antenna element 106 to user 120 when computing device 100 is in another orientation, such as a landscape-secondary orientation, a portrait-primary orientation, or a portrait-secondary orientation.

Relatively to the landscape-primary orientation of antenna element 106, computing device 100 may be rotated 90 degrees clock-wise to put antenna element 106 in the portrait-primary orientation. Relatively to the portrait-primary orientation, computing device 100 may be rotated 90 degrees clock-wise to put antenna element 106 in the landscape-secondary orientation. Relatively to the landscape-secondary orientation, computing device 100 may be rotated 90 degrees clock-wise to put antenna element 106 in the portrait-secondary orientation.

Although FIG. 1B illustrates the landscape-primary orientation of antenna element 106 in which antenna element 106 is in closer physical proximity than other orientations of computing device 100, it should be understood that antenna element 106 may be a distance D1 away from user 120 in other orientations depending on where antenna element 106 is located in computing device 100.

Figure 1C:
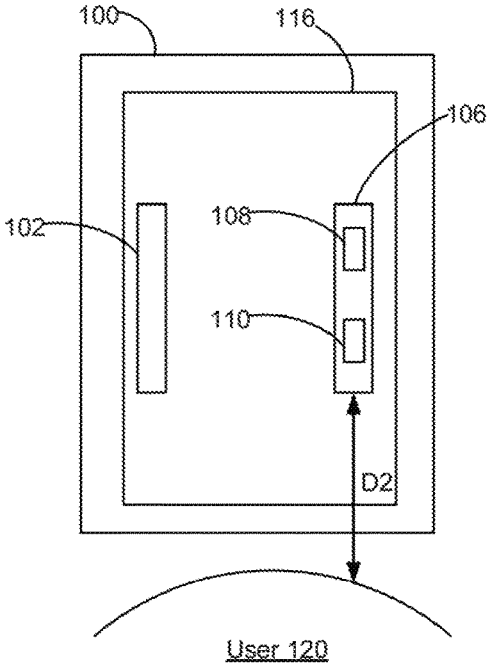

FIG. 1C is a block diagram of an example orientation of antenna element 106 in which second radiating element 110 is enabled and first radiating element 108 is disabled based on a second orientation signal. As illustrated in FIG. 1C, antenna element 106 may be in the portrait-primary orientation. When antenna element 106 has changed from the landscape-primary orientation to the portrait-primary orientation, orientation sensor 102 may detect the change in orientation and may generate a second orientation signal (not shown in FIG. 1C). Controller 104 may disable first radiating element 108 and enable second radiating element 110 based on the second orientation signal. When computing device 100 is in the portrait-primary orientation, antenna element 106 may be a distance D2 away from user 120. Distance D2 may be greater than distance D1.

Figure 2:
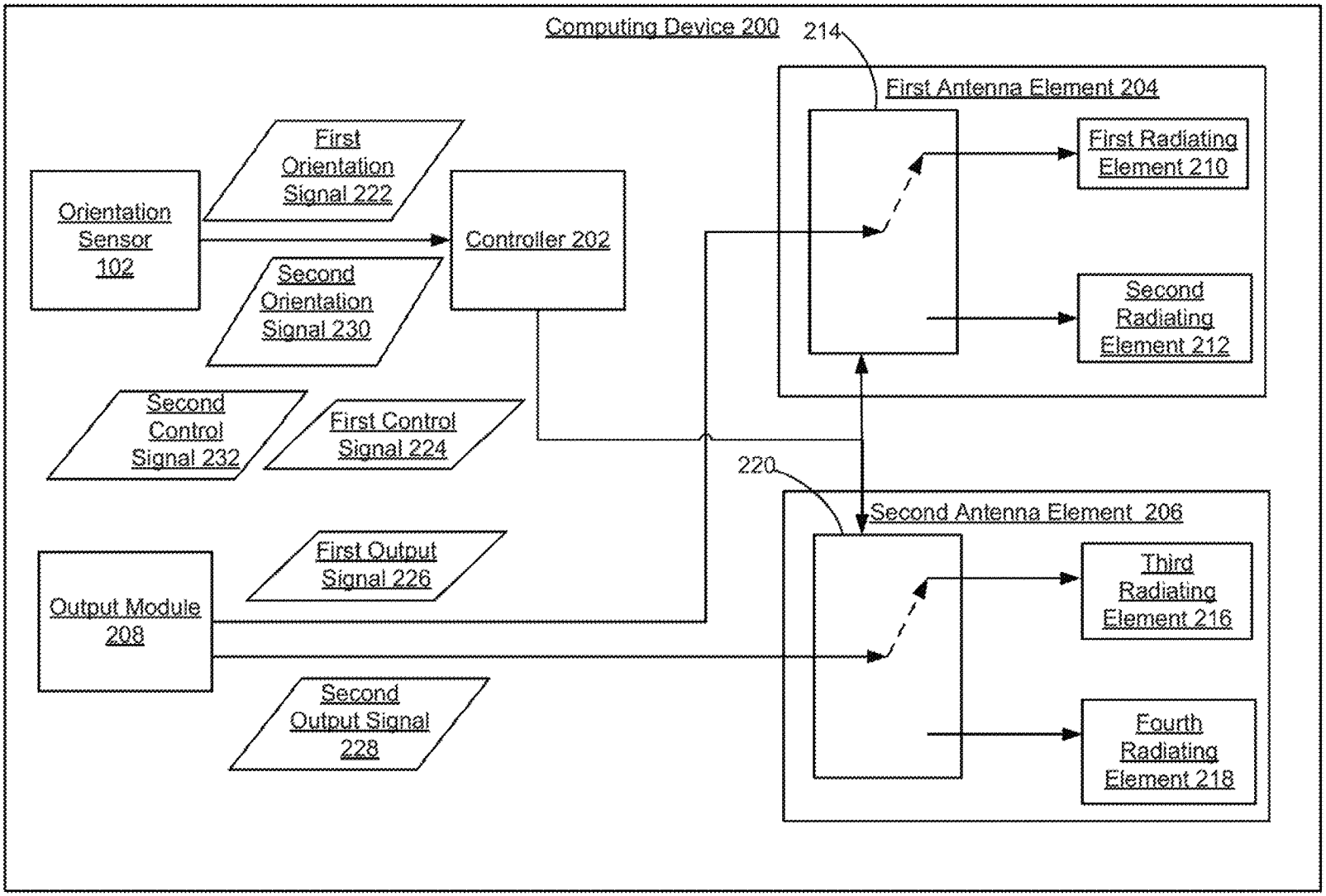
FIG. 2 is a block diagram of another example computing device for enabling a radiating element based on an orientation signal.

FIG. 2 is a block diagram of another example computing device 200 for enabling a radiating element based on an orientation signal. Computing device 200 may include orientation sensor 102 of FIG. 1A, a controller 202, a first antenna element 204, a second antenna element 206, and an output module 208. Controller 202 may be similar to controller 104. First antenna element 204 and second antenna element 206 may be similar to antenna element 106. First antenna element 204 may include a first radiating element 210, a second radiating element 212, and a first switching element 214. Second antenna element 206 may include a third radiating element 216, a fourth radiating element 218, and a second switching element 220. Radiating elements 210 and 216 may be similar to first radiating element 108. Radiating elements 212 and 218 may be similar to second radiating element 110. Switching elements 214 and 220 may include transistors, diodes, any circuits or devices to selectively couple a radiating element to a signal trace. Output module 208 may be a device that generates signals to be transmitted. For example, output module 208 may be a wireless transmitter. During operation, controller 202 may selectively enable and/or disable radiating elements 210, 212, 216, and 218 based on orientations of antenna elements 204 and 206 as indicated by an orientation signal.

When orientation sensor 102 detects that computing device 200 is in a first orientation in which first antenna element 204 and/or second antenna element 206 is in a closer physical proximity to a user than other orientations of first antenna element 204 and/or second antenna element 206, orientation sensor 102 may generate a first orientation signal 222 and transmit first orientation signal 222 to controller 202. Based on first orientation signal 222, controller 202 may selectively enable and/or disable radiating elements 210, 212, 216, and 218 via a first control signal 224.

A first output signal 226 generated by output module 208 may be transmitted via an enabled radiating element of radiating elements 210 and 212. A second output signal 228 generated by output module 208 may be transmitted via an enabled radiating element of radiating elements 216 and 218. Second output signal 228 may be a copy of first output signal 226.

When orientation sensor 102 detects that computing device 200 is in a second orientation, orientation sensor 102 may generate a second orientation signal 230 and transmit second orientation signal 230 to controller 202. Based on second orientation signal 230, controller 202 may selectively enable and/or disable radiating elements 210, 212, 216, and 218 via a second control signal 232. First orientation signal 222 and second orientation signal 230 may be similar to orientation signal 112 of FIG. 1A. Enabling and/or disabling radiating elements 210, 212, 216, and 218 by controller 202 is described in more detail with reference to FIGS. 3A-3D.

Figure 3A:
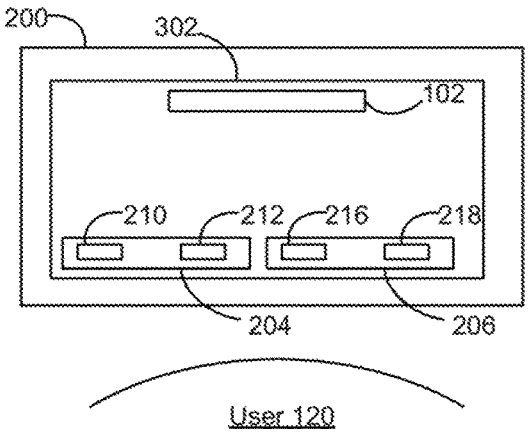
FIG. 3A is a block diagram of an example orientation of antenna elements of FIG. 2 in which a first radiating element and a third radiating element are enabled and a second radiating element and a fourth radiating element are disabled based on an orientation signal.

FIG. 3A is a block diagram of an example orientation of antenna elements 204 and 206 in which first radiating element 210 and third radiating element 216 are enabled and second radiating element 212 and fourth radiating element 218 are disabled based on an orientation signal. In some examples, first antenna element 204 and second antenna element 206 may be located in computing device 200 in a horizontally aligned configuration. For example, antenna elements 204 and 206 may be located on the same side of a display panel 302 of computing device 200.

When controller 202 receives an orientation signal that corresponds to a particular orientation of antenna elements 204 and 206, such as a landscape-primary orientation as illustrated in FIG. 3A, controller 202 may enable that radiating element 210 and third radiating element 216. Controller 202 may disable second radiating element 212 and fourth radiating element 218.

When the orientation signal corresponds to an orientation other than the particular orientation, controller 202 may enable second radiating element 212 and fourth radiating element 218. Controller 202 may also disable first radiating element 210 and third radiating element 216.

In some examples, first antenna element 204 and second antenna element 206 are located in different locations of computing device 200 such that one of first antenna element 204 and second antenna element 206 may be in closer physical proximity to user 120 than the other of first antenna element 204 and second antenna element 206 antenna in other orientations of first antenna element 204 and/or other orientations of second antenna element 206. For example, first antenna element 204 may be located in a first side of display panel 302 and second antenna element 206 may be located in a second side of display panel 302. Orientations of antenna elements 204 and 206 located at different locations of computing device 200 are described in more detail with reference to FIGS. 3B-3D.

Figure 3B:
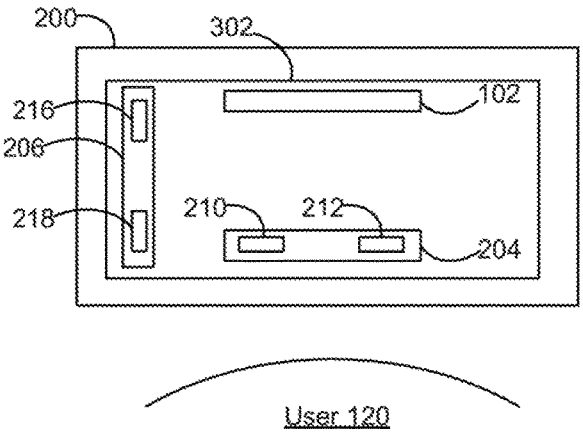
FIG. 3B is a block diagram of another example orientation of antenna elements of FIG. 2 in which a first radiating element and a fourth radiating element are enabled and a second radiating element and a third radiating element are disabled based on an orientation signal.

FIG. 3B is a block diagram of another example orientation of antenna elements 204 and 206 in which first radiating element 210 and fourth radiating element 218 are enabled and second radiating element 212 and third radiating element 216 are disabled based on an orientation signal. As illustrated in FIG. 3B, first antenna element 204 may be located in a first horizontal side of display panel 302 and second antenna element 206 may be located in a first vertical side of display panel 302. First antenna element 204 may be in a landscape-primary orientation and second antenna element 206 may be in a portrait-primary orientation.

When controller 202 receives an orientation signal that corresponds to the landscape-primary orientation of first antenna element 204 or the portrait-primary orientation of second antenna element 206, controller 202 may enable first radiating element 210 and fourth radiating element 218. Controller 202 may also disable second radiating element 212 and third radiating element 216.

Figure 3C:
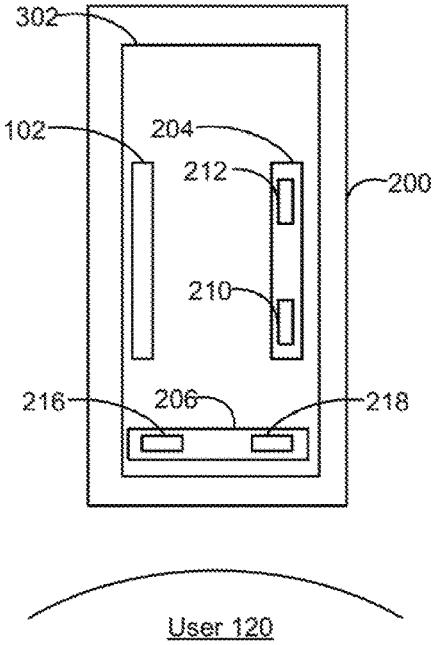
FIG. 3C is a block diagram of another example orientation of antenna elements of FIG. 2 in which a second radiating element and a third radiating element are enabled and a first radiating element and a fourth radiating element are disabled based on an orientation signal.

FIG. 3C is a block diagram of another example orientation of antenna elements 204 and 206 in which second radiating element 212 and third radiating element 216 are enabled and first radiating element 210 and fourth radiating element 218 are disabled based on an orientation signal. As illustrated in FIG. 3C, first antenna element 204 may be in a portrait-secondary orientation and second antenna element 206 may be in a landscape-primary orientation.

When controller 202 receives an orientation signal that corresponds to the landscape-primary orientation of second antenna element 206 or the portrait-secondary orientation of first antenna element 204, controller 202 may enable third radiating element 216 and second radiating element 212. Controller 202 may also disable first radiating element 210 and fourth radiating element 218.

Figure 3D:
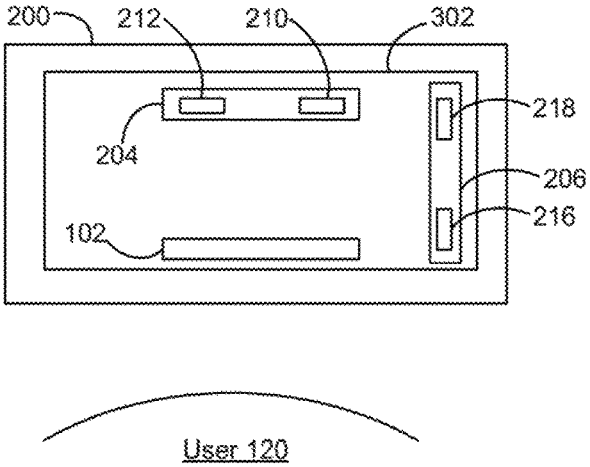
FIG. 3D is a block diagram of another example orientation of antenna elements of FIG. 2 in which a second radiating element and a fourth radiating element are enabled and a first radiating element and a third radiating element are disabled based on an orientation signal.

FIG. 3D is a block diagram of another example orientation of antenna elements 204 and 206 in which second radiating element 212 and fourth radiating element 218 are enabled and first radiating element 210 and third radiating element 216 are disabled based on an orientation signal. As illustrated in FIG. 3D, first antenna element 204 may be in a landscape-secondary orientation and second antenna element 206 may be in a portrait-secondary orientation.

When controller 202 receives an orientation signal that does not correspond to the landscape-primary orientation of first antenna element 204 or the landscape-primary orientation of second antenna element 206, controller 202 may enable second radiating element 212 and fourth radiating element 218. Controller 202 may also disable first radiating element 210 and third radiating element 216. Although FIGS. 2 and 3A-3D illustrate computing device 200 having two antenna elements, it should be understood that computing device 200 may include any number of antenna elements.

Figure 4:
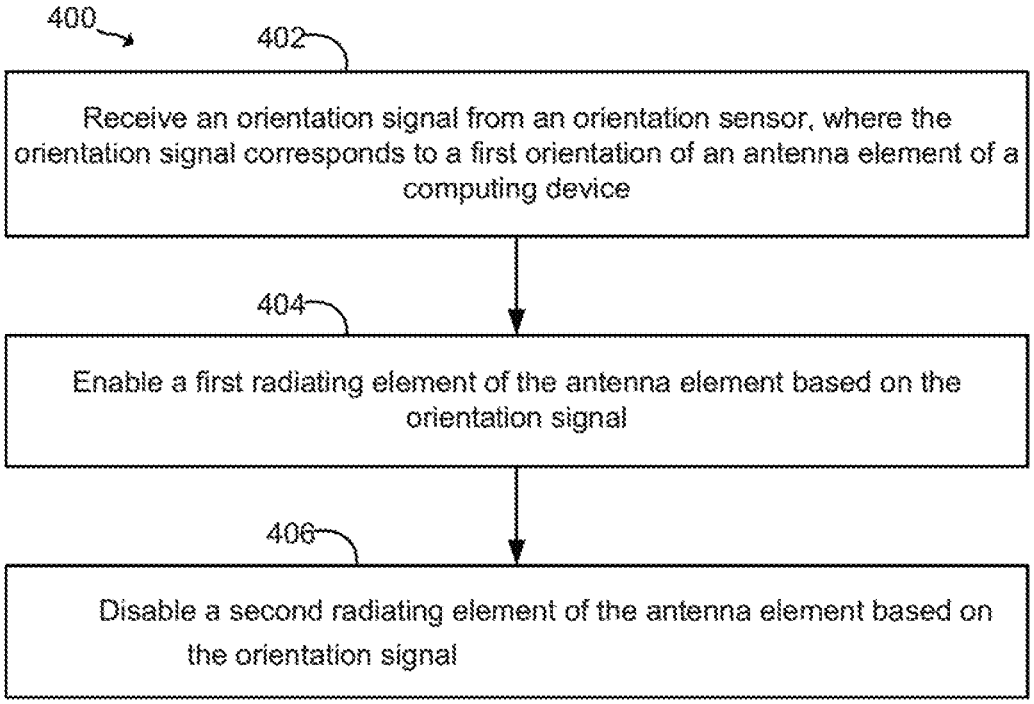
FIG. 4 is an example of a flowchart illustrating an example method of enabling a radiating element based on an orientation signal.

FIG. 4 is an example of a flowchart illustrating an example method 400 of enabling a radiating element based on an orientation signal. Method 400 may be implemented using computing device 100 of FIG. 1A and/or computing device 200 of FIG. 2. Method 400 includes, at 402, receiving an orientation signal from an orientation sensor, where the orientation signal corresponds to a first orientation of an antenna element of a computing device. For example, controller 104 may receive orientation signal 112 from orientation sensor 102. Controller 104 may determine that antenna element 106 is in a closer physical proximity to a user than other orientations of antenna element 106 based on orientation signal 112.

Method 400 also includes enabling a first radiating element of the antenna element based on the orientation signal, at 404. For example, when controller 104 determines that orientation signal 112 corresponds to a first orientation of antenna element 106, controller 104 may enable first radiating element 108. Method 400 further includes disabling a second radiating element of the antenna element based on the orientation signal, at 406. For example, when controller 104 determines that orientation signal 112 corresponds to the first orientation of antenna element 106, controller 104 may disable second radiating element 110.

Figure 5:
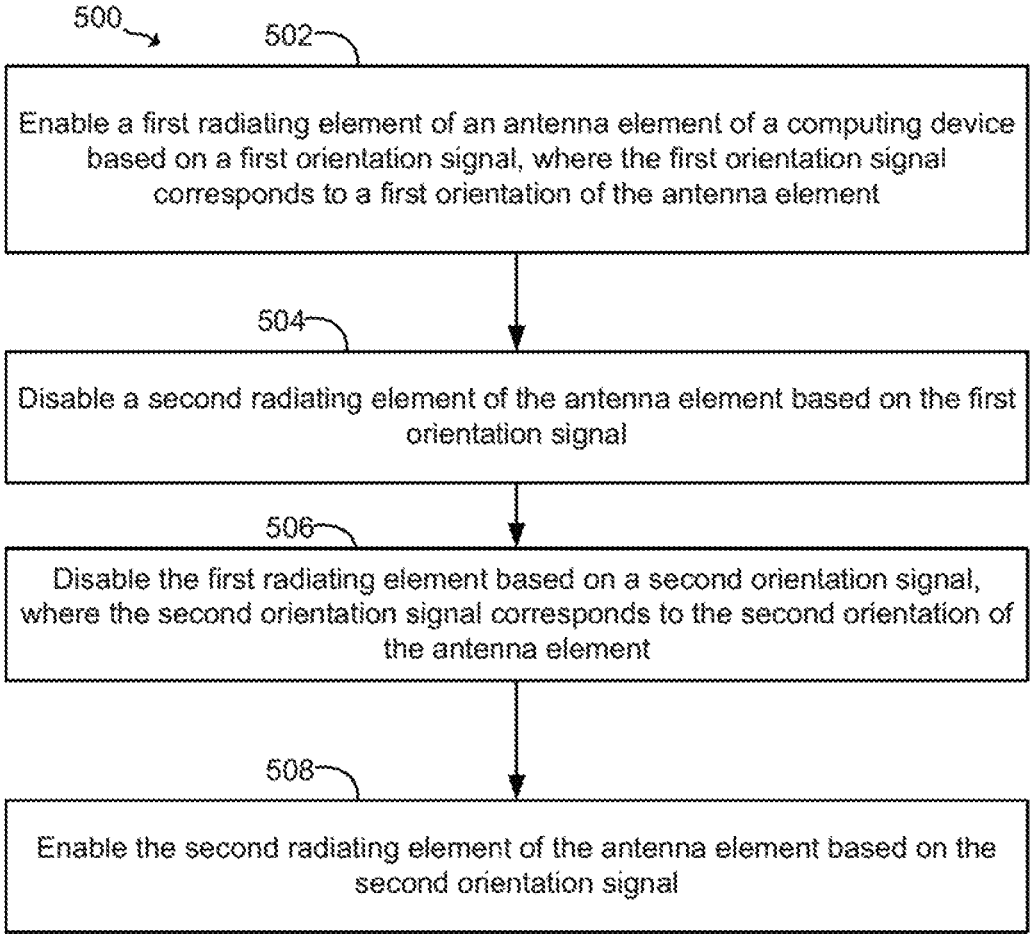
FIG. 5 is an example of a flowchart illustrating another example method of enabling a radiating element based on an orientation signal.

FIG. 5 is an example of a flowchart illustrating another example method 500 of enabling a radiating element based on an orientation signal. Method 500 may be implemented using computing device 100 of FIG. 1A and/or computing device 200 of FIG. 2. Method 500 includes, at 502, enabling a first radiating element of an antenna element of a computing device based on a first orientation signal, where the first orientation signal corresponds to a first orientation of the antenna element. For example, when controller 104 determines that orientation signal 112 corresponds to a first orientation of antenna element 106, controller 104 may enable first radiating element 108.

Method 500 also includes a enabling a second radiating element of the antenna element based on the first orientation signal, at 504. For example, when controller 104 determines that orientation signal 112 corresponds to the first orientation of antenna element 106, controller 104 may disable second radiating element 110.

Method 500 further includes, at 506, disabling the first radiating element of the antenna element based on a second orientation signal, where the second orientation signal corresponds to the second orientation of the antenna element. For example, when controller 104 determines that orientation signal 112 or another orientation signal that corresponds to another orientation that is different from the first orientation, controller 104 may disable first radiating element 108.

Method 500 further includes enabling the second radiating element of the antenna element based on the second orientation signal, at 508. For example, when controller 104 determines that orientation signal 112 or another orientation signal that corresponds to another orientation that is different from the first orientation, controller 104 may enable second radiating element 110.

Figure 6:
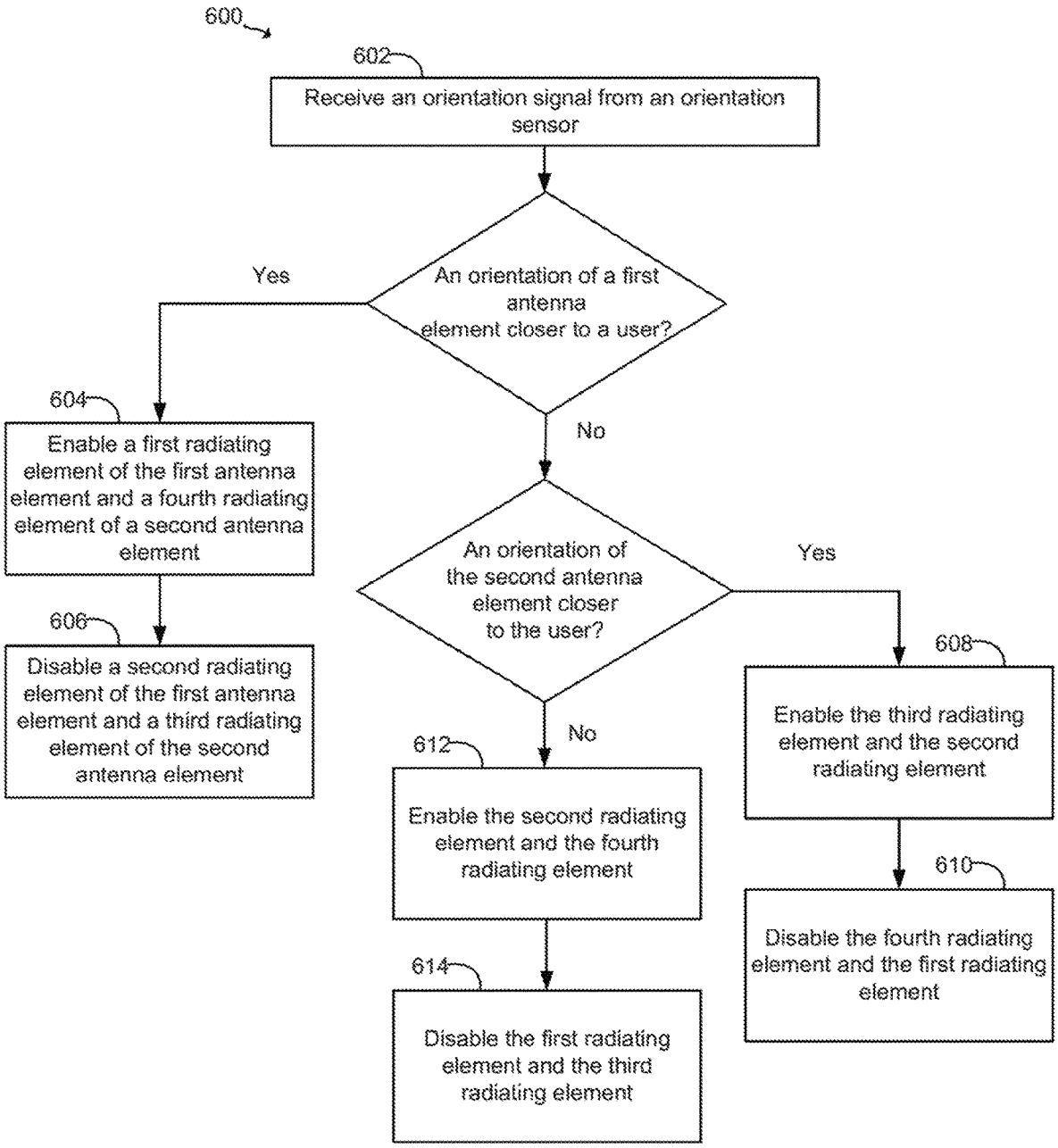
FIG. 6 is an example of a flowchart illustrating another example method of enabling a radiating element based on an orientation signal.

FIG. 6 is an example of a flowchart illustrating another example method 600 of enabling a radiating element based orientation signal. Method 600 may be implemented using computing device 100 of FIG. 1A and/or computing device 200 of FIG. 2. Method 600 includes receiving an orientation signal from an orientation sensor, at 602. For example, controller 104 may receive orientation signal 112 from orientation sensor 102.

Method 600 also includes when the orientation signal corresponds to a first particular orientation of a first antenna element of a computing device in which the first antenna element is closer to a user than other orientations of the first antenna element and other orientations of a second antenna element of the computing device, enabling a radiating element of the first antenna element and a fourth radiating element of a second antenna element, at 604. For example, controller 202 may enable first radiating element 210 and fourth radiating element 218 based on an orientation signal.

Method 600 further includes disabling a second radiating element of the first antenna element and a third radiating element of the second antenna element, at 606. For example, controller 202 may disable second radiating element 212 and third radiating element 216 based on an orientation signal.

Method 600 further includes when the orientation signal corresponds to a second particular orientation of the second antenna element in which the second antenna element is closer to the user than other orientations of the second antenna element and other orientations of the first antenna element, enabling the third radiating element and the second radiating element, at 608. For example, controller 202 may enable third radiating element 216 and second radiating element 212 based on an orientation signal.

Method 600 further includes disabling the fourth radiating element and the first radiating element, at 610. For example, controller 202 may also disable first radiating element 210 and fourth radiating element 218 based on an orientation signal.

Method 600 further includes when the orientation signal does not correspond to the first particular orientation or the second particular orientation, enabling the second radiating element and the fourth radiating element, at 612. For example, controller 202 may enable second radiating element 212 and fourth radiating element 218. Method 600 further includes disabling the first radiating element and the third radiating element, at 614. For example, controller 202 may also disable first radiating element 210 and third radiating element 216 based on an orientation signal.

Figure 7:
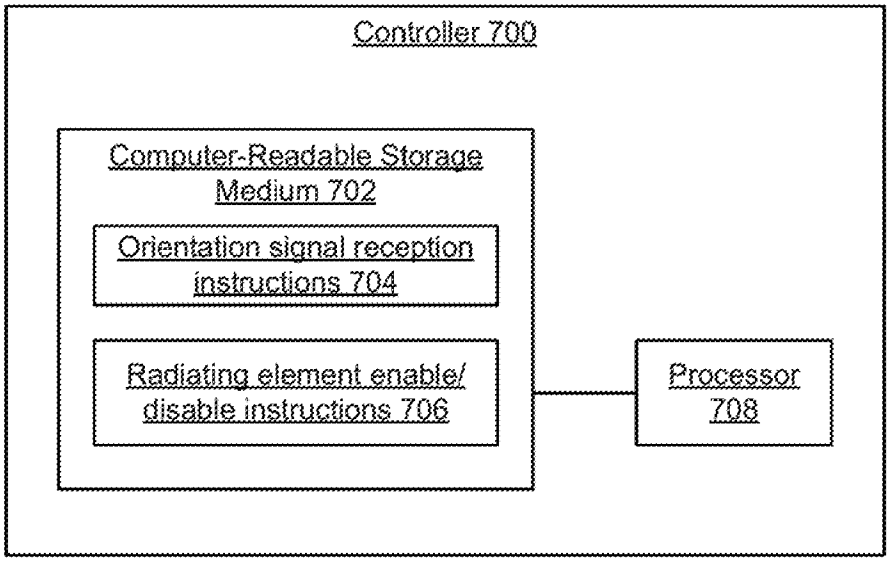
FIG. 7 is a block diagram of an example controller including a computer-readable medium having instructions to enable a radiating element based on an orientation signal.

FIG. 7 is a block diagram of an example controller 700 including a computer-readable medium 702 having instructions to enable a radiating element based on an orientation signal. In some examples, computer-readable storage medium 702 may be a non-transitory computer-readable storage medium where the term "non-transitory" does not encompass transitory propagating signals. Controller 700 may be similar to controller 104 of FIG. 1A and/or controller 202 of FIG. 2. Computer-readable storage medium 702 may include instructions 704 and 706 that, when executed by a processor 708, may cause controller 700 to perform operations described below.

For example, orientation signal reception instructions 704 may be executable to cause controller 700 to receive an orientation signal, such as orientation signal 112, first orientation signal 222, or second orientation signal 230. Radiating element enable/disable instructions 706 may be executable to cause controller 700 to enable and/or disable a radiating element, such as radiating elements 108, 110, 210, 212, 216, and 218.

The use of "comprising", "including" or "having" are synonymous and variations thereof herein are meant to be inclusive or open-ended and do not exclude additional unrecited elements or method steps.

What is claimed is:

1. A computing device comprising:

an orientation sensor;

a display panel including a plurality of sides;

an antenna element located entirely on a same side of the plurality of sides, wherein the antenna element includes a first radiating element, a second radiating element, and a switching element to selectively enable one of the first radiating element and the second radiating element to alter the power output of the antenna element; and a controller to:

enable the first radiating element within the antenna element, via the switching element, to transmit an output signal based on the orientation signal received from the orientation sensor causing the antenna element to have a first power output that is compliant with a specific absorption rate (SAR) limit when the antenna element is in the first orientation, wherein the orientation signal corresponds to a first orientation of the antenna element; and disable the second radiating element within the antenna element, via the switching element, based on the orientation signal, wherein the second radiating element has a second power output that exceeds the SAR limit when the antenna element is in the first orientation.

2. The computing device of claim 1, wherein the controller further to:

disable the first radiating element based on a second orientation signal from the orientation sensor, wherein the second orientation signal corresponds to the second orientation of the antenna element; and enable the second radiating element based on the second orientation signal.

3. The computing device of claim 1, further comprising a second antenna element, wherein the second antenna element includes a third radiating element and a fourth radiating element, wherein the controller further to:

enable the third radiating element to transmit the output signal based on the orientation signal; and disable the fourth radiating element based on the orientation signal.

4. The computing device of claim 1, wherein the second power output is compliant with the SAR when the antenna element is in a second orientation different from the first orientation.

5. The computing device of claim 4, wherein the first orientation corresponds to a landscape-primary orientation, and wherein the second orientation corresponds to a landscape-secondary orientation, a portrait-primary orientation, or a portrait-secondary orientation.

6. The computing device of claim 1, wherein the first radiating element includes a first antenna trace, wherein the second radiating element includes a second antenna trace, and wherein the first antenna element trace has a different length than the second antenna element trace.

7. The computing device of claim 1, wherein the switching element includes a transistor, a diode, or a combination thereof.

8. The computing device of claim 1, wherein the SAR limit is 1.6 watts per kilogram.

9. The computing device of claim 1, wherein the orientation sensor includes a gravity sensor, an accelerometer, or a combination thereof.

10. A method comprising:

receiving, at a controller of a computing device having a display panel including a plurality of sides, an orientation signal from an orientation sensor, wherein the orientation signal corresponds to a first orientation of an antenna element of the computing device, wherein the antenna element is located entirely on a same side of a plurality of sides of and includes a first radiating element, a second radiating element, and a switching element;

enabling, at the controller, the first radiating element within the antenna element, via the switching element, to transmit an output signal based on the orientation signal causing the antenna element to have a first power output that is compliant with a specific absorption rate (SAR) limit when the antenna element is in the first orientation; and disabling, at the controller, the second radiating element within the antenna element, via the switching element, based on the orientation signal, wherein the first radiating element has the first power output that is different than a second power output of the second radiating element.

11. The method of claim 10, further comprising:

disabling the first radiating element based on a second orientation signal received from the orientation sensor, wherein the second orientation signal corresponds to the second orientation of the antenna element; and enabling the second radiating element based on the second orientation signal.

12. The method of claim 11, wherein the first orientation corresponds to a landscape-primary orientation, and wherein the second orientation corresponds to a landscape-secondary orientation, a portrait-primary orientation, or a portrait-secondary orientation.

13. The method of claim 10, further comprising:

receiving, at the controller, a second orientation signal from the orientation sensor, wherein the second orientation signal corresponds to a particular orientation of a second antenna element of the computing device;

enabling a third radiating element of the second antenna element and the second radiating element based on the second orientation signal, wherein the third radiating element has a third power output that is compliant with a specific absorption rate (SAR) of less than 1.6 watts per kilogram when the second antenna element is in the particular orientation; and disabling a fourth radiating element of the second antenna element and the first radiating element based on the second orientation signal, wherein the fourth radiating element has a fourth power output that exceeds the SAR of 1.6 watts per kilogram when the second antenna element is in the particular orientation.

14. A computer-readable storage medium comprising instructions that when executed cause a controller of a computing device having a display panel including a plurality of sides to:

receive an orientation signal from an orientation sensor, wherein the orientation signal corresponds to a first orientation of an antenna element that is in closer physical proximity to a user than a second orientation of the antenna element, wherein the antenna element is located entirely on a same side of a plurality of sides of the display panel and includes a first radiating element, a second radiating element, and a switching element to selectively enable one of the first radiating element and the second radiating element to alter the power output of the antenna element;

enable the first radiating element within the antenna element, via the switching element, to transmit an output signal based on the orientation signal causing the antenna element to have a first power output that is compliant with a specific absorption rate (SAR) limit when the antenna element is in the first orientation; and disable the second radiating element within the antenna element, via the switching element, based on the orientation signal, wherein the second radiating element has a second power output that exceeds the SAR limit when the antenna element is in the first orientation.

15. The computer-readable medium of claim 14, further comprising instructions that when executed cause the controller to:

disable the first radiating element based on a second orientation signal received from the orientation sensor, wherein the second orientation signal corresponds to the second orientation of the antenna element; and enable the second radiating element based on the second orientation signal.

* * * * *